US005273236A

United States Patent [19]

Wootton et al.

[11] Patent Number: 5,273,236

[45] Date of Patent: Dec. 28, 1993

[54] MULTIPLE DESIGNATION MISSILE SYSTEM

[75] Inventors: John R. Wootton; Gary Waldman, both of St. Louis; Gregory L. Hobson, St. Peters, all of Mo.

[73] Assignee: Electronics & Space Corp., St. Louis, Mo.

[21] Appl. No.: 984,476

[22] Filed: Dec. 2, 1992

[51] Int. Cl.[5] ..... F41G 7/30; F41G 9/00

[52] U.S. Cl. ..... 244/3.11

[58] Field of Search ..... 244/3.11, 3.13, 3.12; 382/1, 65; 356/4

[56] References Cited

U.S. PATENT DOCUMENTS 4,924,507 5/1990 Chao et al. ..... 382/31
5,042,743 8/1991 Carney ..... 244/3.11
5,062,586 11/1991 Hobson et al. ..... 244/3.12

*Primary Examiner*—Ian J. Lobo

*Attorney, Agent, or Firm*—Polster, Lieder, Woodruff & Lucchesi

[57] ABSTRACT

Apparatus (10) is provided for designating a plurality of objects (E1-E3) within a field of view (FOV) and for thereafter simultaneously tracking each of the objects. A field of view is first defined in which one or more objects may be located. A laser beam generator (12) generates a laser beam (B) and directs it into the field of view. A beam steering mechanism (14) steers the laser beam throughout the field of view for it to strike each of the objects appearing therein. A coder unit (22) generates a code uniquely designating each object. A multiple target tracker (20) thereafter simultaneously tracks each separate object. The tracker controls the steering mechanism to sequentially steer the laser beam to each designated object. The laser, via the steering mechanism, illuminates all, or one or more, of the desginated, tracked targets within the field of view.

26 Claims, 2 Drawing Sheets

MULTIPLE DESIGNATION MISSILE SYSTEM

BACKGROUND OF THE INVENTION

This invention relates to beam steered lasers and, more particularly, to a beam steered laser used in a battlefield environment to designate one of a plurality of targets of opportunity.

The success of lasers on the battlefield is well established. Examples of this include not only laser guided bombs, but also shells and missiles. While successful, the weapons systems in which these munitions are used have certain drawbacks. For example, each munition has an associated sighting system whose sole function is to direct the munition to a target. Thus, for example, a laser designator illuminates a target at a fixed laser frequency which is coded for security purposes. Back scatter, or forward scatter, of the illuminating laser frequency, off the target, is received decoded, and used as a beacon to guide the munition to the target.

Present sighting systems typically require that the target be illuminated throughout the flight of the munition to the target. Further, lasers used in the pointing system are mechanically boresighted to the center of a field of view of the system. As a result, laser designation of a target may be considered a sequential operation. That is, if more than one target is present in the field of view, they must be sequentially dealt with one at a time. Also, the designator sight is used for guidance only during a specified munition guidance interval. These factors result in a) a long exposure time of the weapon system and its user and, in turn, the risk to each; and, b) an inoperable designator surveillance system during the guidance interval.

Various steps have been undertaken to ameliorate these drawbacks. For example, multiple target designation systems have been developed. Such a system is disclosed in U. S. Pat. No. 5,042,743, which is assigned to the same assignee as the present application. In addition, recent advances in laser technology have produced a solid state, beam steerable laser. If such a laser is employed in the weapons system, it is no longer necessary to limit the laser to the center of the field of view of the pointing system. If there is no boresighting requirement, then the system can be made a great deal more flexible. Now, the laser can be beam steered to any location within the field of view, this being done at rates exceeding a few kilohertz. As a result, a much more flexible sighting and guidance system is now possible which provides a safer and more effective weapons system for use on the battlefield.

SUMMARY OF THE INVENTION

Among the several objects of the present invention may be noted the provision of a target designation system for use in battlefield environments; the provision of such a system which allows the user to designate multiple targets present within a field of view of the system and to thereafter simultaneously track each target; the provision of such a system to significantly reduce the exposure time of the user of the system thereby reducing their potential for harm; the provision of such a system employing laser beam steering technology; the provision of such a system to uniquely identify each designated target; the provision of such a system to reference each target with a weapon used to destroy the target; the provision of such a system to quickly and accurately track each designated target; the provision of such a system in which a target can be designated and tracked by a laser on one weapon's platform with a munitions being launched at the target from a separate platform; and, the provision of such a system which is easy to use and is adaptable for use on existing weapon's platforms.

In accordance with the invention, generally stated, apparatus is provided for designating a plurality of objects within a field of view, and for thereafter simultaneously tracking each of the objects. A field of view is first defined in which one or more objects may be located. A laser beam is generated and directed into the field of view. A beam steering mechanism is employed for steering the laser beam throughout the field of view for it to strike each of the objects found therein. Each object designated by the laser beam striking it is uniquely identified for subsequent tracking. Thereafter, each separate object is simultaneously tracked. This is accomplished by controlling the steering mechanism to sequentially steer the laser beam to each designated object. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
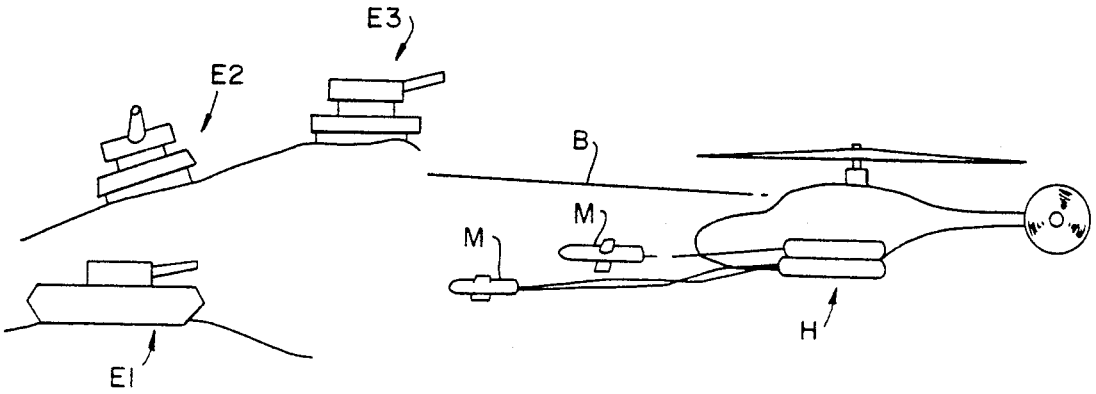
FIG. 1 represents a battlefield in which a weapon's platform has a plurality of targets which it can selectively attack.

Referring to the drawings, a helicopter H is shown in FIG. 1. The helicopter serves as a weapons' platform in that it is configured to carry a plurality of weapons, in this instance, HELLFIRE missiles M. Missiles M are well-known in the art, and their description and manner of operation will not be described in detail. In general, a gunner on the helicopter uses a sighting system which generates a field of view in which one or more enemy vehicles E1-E3 are located. The gunner selects one of the vehicles to attack. He designates the target by illuminating it with coded laser energy. Back scattered energy from the target is sensed by a missile's seeker head which locks onto the target. After the missile is launched, the energy signal guides missile M to the target. A drawback in current missile systems is that in a "target rich" environment such as depicted in FIG. 1, the gunner must select and destroy first one target, then a second, then a third, etc. Since it takes time to select and destroy each target, the helicopter is exposed to enemy fire for a long period of time. Thus, the helicopter and its occupants are at significant risk. It will be understood this same situation would occur if the helicopter were a tank or other weapons' platform, and the weapon were some other type munition which required its user to select a target and then direct the munitions to it. It will be further appreciated that in many weapons' systems, a number of munitions may be readily available for use at all times during the period the user is selecting and destroying individual targets.

Multiple target trackers are currently available. One such tracker is described in U.S. Pat. No. 5,062,586 is assigned to the same assignee as the present application. In addition, U.S. Pat. No. 5,042,743, which is assigned to the same assignee as the present application, describes apparatus and a method for multiple target engagement. These patents are incorporated herein by reference.

Figure 3:
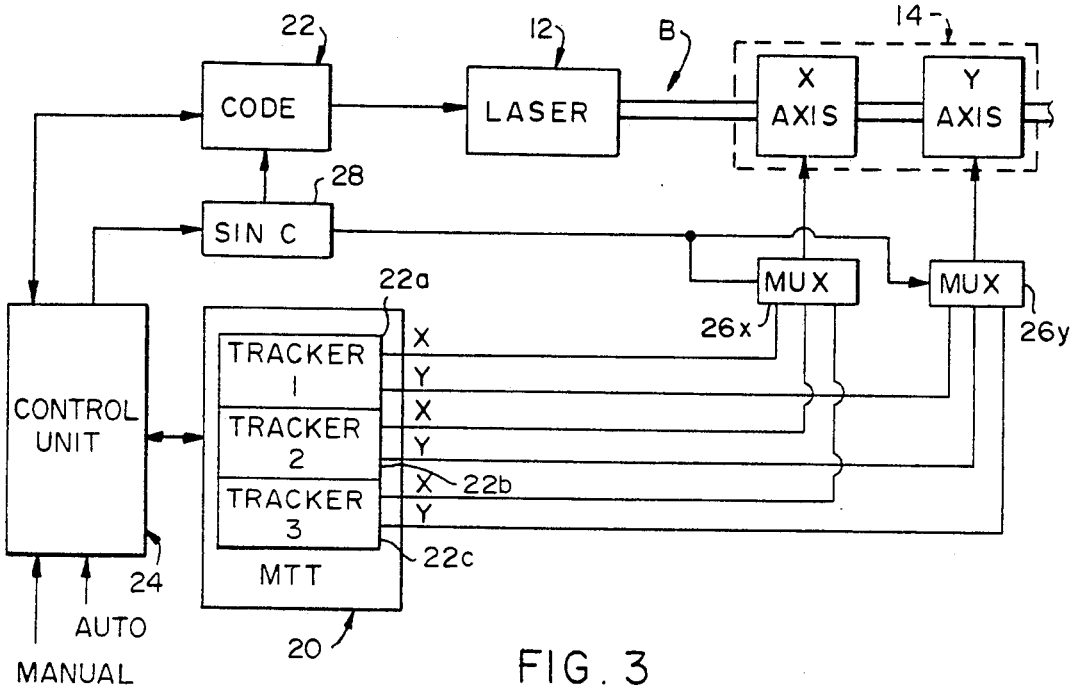
FIG. 3 is a block diagram illustrating use of the apparatus to simultaneously track a plurality of separately designated targets; and, FIGS. 4*a*-4*d* illustrate respective steering mechanisms for steering a laser beam of the apparatus.

Referring to FIG. 3, apparatus of the present invention is indicated generally 10. The apparatus is used with the weapons' system in the battlefield environment to target and destroy enemy targets E. A major advantage of the apparatus is that it can separately designate each of a plurality of targets; i.e., the tanks E1–E3, which appear in a field of view. Once the targets have been designated, the apparatus thereafter simultaneously tracks each distinct target.

Apparatus 10 first includes means defining a field of view FOV (see FIG. 2) in which one or more of the targets may appear. This means may be comprised by the sight control unit 62 disclosed in U.S. Pat. No. 5,062,586; or, it may be effected by another convenient means. The apparatus next includes a laser means 12 for generating a laser beam B. The laser beam is directed at the field of view so it can illuminate each target therein. Once illuminated, the targets can be readily identified by the person operating the weapons' system and looking at the field of view.

Figure 4A:
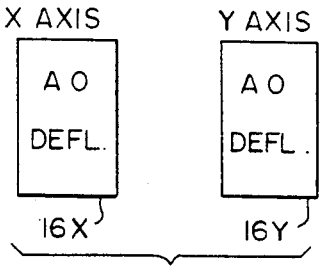
Figure 4B:
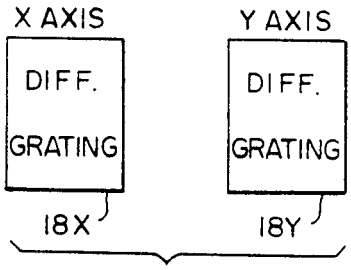
Figure 4C:
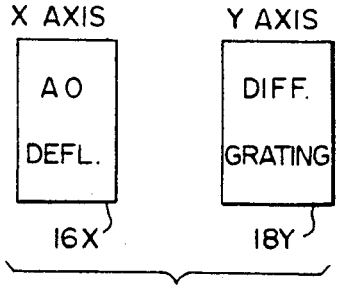
Figure 4D:
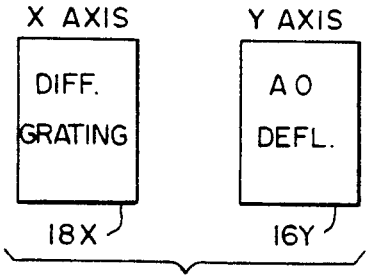

An important feature of apparatus 10 is a steering means indicated generally 14 for selectively steering the laser beam at each target within the field of view. As shown in FIG. 3, beam B is steerable in both the x and y axes. Referring to FIGS. **4*a*–4*d*, various embodiments of steering means 12 are shown. In FIG. 4*a*, the respective x and y axis steering is accomplished by use of acousto-optic deflectors 16*x* and 16*y*, or any other form of Bragg deflection. In FIG. 4*b*, this two axis steering is accomplished using respective diffraction gratings 18x and 18y. In FIG. 4*c*, steering in the x-axis is accomplished using acousto-optic deflector 16*x*; while steering in the y-axis is accomplished using a diffraction grating 18*y* in association with tuning the laser frequency. In FIG. 4*d*, the reverse occurs, with x-axis steering being done with the integrated diffraction grating 18*x*, and y-axis steering being achieved with acousto-optical deflector 16*y***. It will be understood that other steering mechanisms can be used either separately, or in combination with the steering elements shown. The important aspect of using acousto-optic deflectors (i.e., Bragg Cells), or diffraction grating combination, is that the laser beam must be independently steerable in each axis.

Initially, steering of the laser beam may be either manually controlled by the operator of the weapons' system; or, the apparatus may automatically steer the laser throughout the field of view until an object which the apparatus identifies as a target is located by the beam. In either instance, once a target has been struck by the beam, the x-y co-ordinates for that target are supplied to a tracking means 20. The tracking means includes a plurality of tracker units **22*a*–22*c***. The *x–y* co-ordinates for each identified target are separately stored in the respective units. It will be understood that while tracking means 20 includes three tracking units in FIG. 3, the tracking unit could include more such units. Tracking means 20 is a multiple target tracking means as described, for example, in U.S. Pat. No. 5,062,586.

When the laser beam initially locates a target, a coding means 22 generates a code which uniquely designates the target. This code is subsequently used in tracking the target. This enables the apparatus to readily distinguish between targets. In a manual mode of operation, the operator may selectively designate or "tag" a target. When he does, the coding means generates the unique code for that target. If the operator elects not to "tag" that particular target; for example, it may be a truck and therefore not considered a threat, as opposed to an enemy tank which should be attacked, he can manually override the coding system so no code is generated for the object. In an automatic mode of operating, each target identified is designated with a unique code. Thereafter, the operator may have the option of "de-selecting" the target. Otherwise, the code generated for each separate target is now stored in the tracking means.

A control unit 24 controls operation of the apparatus. The control unit is used, for example, to indicate whether the apparatus is manually or automatically to designate targets. Once all the selected targets have been designated, the control unit causes the apparatus to thereafter simultaneously track each designated target. It does this, as described hereinafter, through tracking means 20. The tracking means, in turn, controls steering means 14 to sequentially steer laser beam B to each designated target E. The weapons, system platform such as helicopter H, launches a separate missile M at each designated target from its launchers L. Or, the missiles can be launched from one or more separate platforms. The important aspect is that each missile is set to track a separately designated target. Apparatus 10 associates a separate missile with each separate target. Each missile is now independently guided to its associated target.

Figure 2:
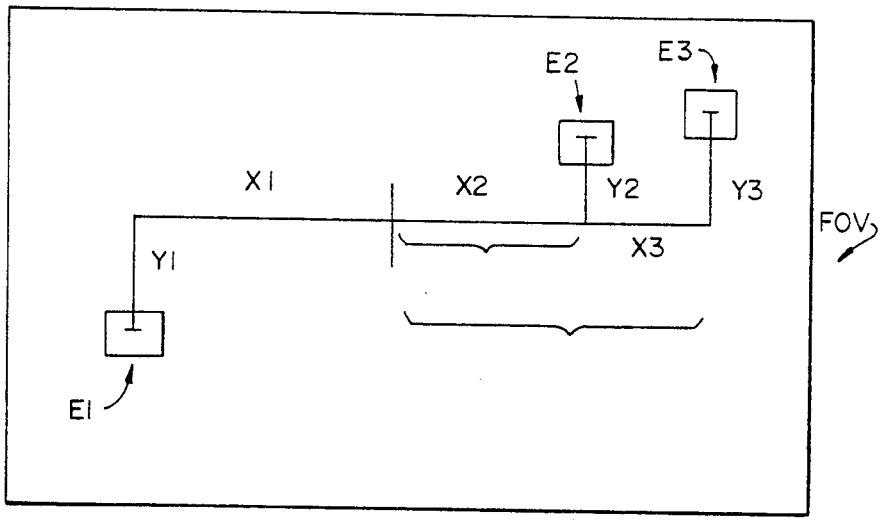
FIG. 2 is a representation of a field of view display generated by the apparatus of the present invention in which a multitude of separately designatable targets are located.

With respect to the multiple missile guidance capabilities of apparatus 10, as shown in FIG. 2, each target in the field of view has a different set of x-y co-ordinates. As shown, target E1 has co-ordinates $x_1$, $y_1$; target E2 co-ordinates $x_2$, $y_2$; and, target E3 co-ordinates $x_3$, $y_3$. The initial co-ordinates for each target are stored in the respective tracker units 22a-22c when the targets are first designated. Now, for each scan of the field of view, the x co-ordinates for each target are supplied to a first multiplexer unit 26x, and the y co-ordinates to a second multiplexer unit 26y. Next, a synchronization unit 28 simultaneously provides a synchronization signal to both the multiplexers and the coding means 22. Unit 28, in turn, is controlled by control unit 24. Upon receipt of each synchronization signal, multiplexer 26x supplies an x co-ordinate for one of the targets to the x-axis steering mechanism of steering means 14. Simultaneously, multiplexer **26*y* supplies the y co-ordinate for the same target to the y-axis steering mechanism of means 14. At the same time, coding means 22 is indexed to provide the unique identifier code for that target. In response to the inputs from the multiplexers, steering means 14** adjusts the direction of beam B so it is directed at (deflected toward) the appropriate target E. Because the target may be moving, the direction the beam is pointing may need to be slightly adjusted to a new set of x-y co-ordinates. If so, these new co-ordinates are now stored in the appropriate tracker unit. Since the unique code for each target is available while the target is being scanned, the possibility of a storage error is eliminated.

Further, because of the scan rate of the apparatus, the location of each target within the field of view is continuously updated so the actual location of each target is known at all times.

After missile launch, each target is continuously illuminated with the coded laser radiation. The seeker in each missile tracks the target in response to the back scatter. Because each target is illuminated with a separate coded signal, each missile converges on its individual target.

What has been described is apparatus by which multiple objects within a field of view can be first spotted, then designated as a target, and thereafter simultaneously tracked and illuminated with laser radiation so that separate missiles, or other munitions, can be guided to the targets to destroy them. The apparatus is particularly advantageous in that enabling the weapons platform to simultaneously attack a plurality of targets significantly lessens the threat of harm to the platform and its users. This is because the platform no longer needs to sequentially identify and attack individual targets. By reducing the "dwell" time of the platform in a danger zone, the survivability of the platform is increased.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. Apparatus for designating a plurality of objects within a field of view and for thereafter simultaneously tracking each of the objects comprising:

means defining a field of view in which one or more objects may be located;

means for generating a laser beam and directing it into the field of view;

means for steering the laser beam throughout the field of view to strike each of the objects therein;

coding means responsive to the laser beam striking an object to uniquely identify each separate object; and, tracking means for thereafter simultaneously tracking each separate object, said tracking means controlling the steering means to sequentially steer the laser beam to each designated object.

2. The apparatus of claim 1 wherein the tracking means comprises a multiple target tracker capable of storing individual sets of co-ordinates for each object designated within the field of view.

3. The apparatus of claim 2 wherein the coding means includes means for designating each object with a unique code by which the tracking means thereafter designates the object.

4. The apparatus of claim 3 wherein the laser means is independently steerable in two axes and the steering means includes means for steering the laser beam in each axis.

5. The apparatus of claim 4 wherein the steering means includes a pair of acousto-optic deflectors, one for steering the laser beam in each axis.

6. The apparatus of claim 4 wherein the steering means includes a pair of diffraction gratings, one for steering the laser beam in each axis.

7. The apparatus of claim 4 wherein the steering means includes an acousto-optic deflector for steering the laser beam in one axis, and an integrated diffraction grating for steering the laser beam in the other axis.

8. The apparatus of claim 4 wherein the tracking means includes multiplexing means for sequentially providing the respective sets of object co-ordinates to the steering means for the steering means to sequentially steer the laser beam to each designated object.

9. The apparatus of claim 8 further including synchronizing means for synchronizing the unique code for each designated object with the co-ordinate set for that object whereby the tracking means can identify each object and its location within the field of view.

10. The apparatus of claim 1 further including means for launching munitions at each object from a launching platform, the launching means being on a separate platform from that on which the remaining means of the apparatus are located.

11. In a weapons system for use in a battlefield environment to target and destroy enemy targets, apparatus for separately designating each of a plurality of targets within a field of view and for thereafter simultaneously tracking each target comprising:

means defining a field of view in which one or more targets may appear;

laser means for generating a laser beam and directing at the targets;

steering means for steering the laser beam at each target within the field of view;

coding means responsive to the laser beam striking a target to uniquely designate the target;

tracking means for simultaneously tracking each designated target, said tracking means controlling the steering means to sequentially steer the laser beam to each designated target; and, weapons means for launching a separate weapon at each designated target, a targeting means associating a separate weapon with each separate target, and said targeting means independently guiding each weapon to its associated target, whereby the weapons can be used to simultaneously attack a plurality of targets thereby lessening the threat of harm to the user of the weapons system.

12. The apparatus of claim 11 wherein the targeting means comprises a multiple target tracker capable of storing individual sets of co-ordinates for each designated target.

13. The apparatus of claim 12 wherein the coding means includes means for tagging each separate target with a unique code by which the tracking means thereafter designates the target.

14. The apparatus of claim 13 wherein the laser means is steerable in two axes and the steering means includes means for independently steering the laser beam in each axis.

15. The apparatus of claim 14 wherein the steering means includes a pair of acousto-optic deflectors, one for steering the laser beam in each axis.

16. The apparatus of claim 14 wherein the steering means includes a pair of diffraction gratings, one for steering the laser beam in each axis.

17. The apparatus of claim 14 wherein the steering means includes an acousto-optic deflector for steering the laser beam in one axis, and an integrated diffraction grating for steering the laser beam in the other axis.

18. The apparatus of claim 14 wherein the tracking means includes multiplexing means for sequentially providing the respective sets of target co-ordinates to the steering means for the steering means to sequential steer the laser beam to each designated target.

19. The apparatus of claim 18 further including synchronizing means for synchronizing the unique code for each designated target with the co-ordinate set for that target whereby the tracking means can identify each target and its location within the field of view.

20. A method for use in a battlefield environment to separately designate each of a plurality of targets within a field of view and for thereafter simultaneously tracking each target so it can be destroyed comprising:

defining a field of view in which one or more targets may appear;

generating a laser beam and directing it at the targets;

sequentially steering the laser beam at each target within the field of view;

coding each target struck by the laser beam to uniquely designate the target;

simultaneously tracking each designated target including sequentially steering the laser beam to each designated target; and, launching a separate weapon at each designated target and independently guiding each weapon to its associated target, wherein the weapons are used to simultaneously attack a plurality of targets thereby lessening the threat of harm to the user of the weapons system.

21. The method of claim 20 further including steering the laser beam in two axes.

22. The method of claim 21 including steering the laser beam with a pair of acousto-optic deflectors, one for steering the laser beam in each axis.

23. The method of claim 21 including steering the laser beam with a pair of diffraction gratings, one for steering the laser beam in each axis.

24. The method of claim 21 including steering the laser beam with an acousto-optic deflector in one axis, and an integrated diffraction grating in the other axis.

25. The method of claim 20 wherein tracking each separately designated target includes multiplexing target location information to a steering means by which the laser beam is steered for sequentially providing respective sets of target co-ordinates to the steering means for the steering means to sequentially steer the laser beam to each designated target.

26. The method of claim 21 further including independently steering the laser beam in each axis.

* * * * *